US006757996B1

(12) United States Patent
Bellavich

(10) Patent No.: US 6,757,996 B1
(45) Date of Patent: Jul. 6, 2004

(54) PORTABLE MULTIPLE USE QUILTING FRAME SYSTEM

(76) Inventor: Ronald C. Bellavich, 445 Surveyors Pt, Suwanee, GA (US) 30024

( * ) Notice: Subject to any disclaimer, the term of this patent is extended or adjusted under 35 U.S.C. 154(b) by 0 days.

(21) Appl. No.: 10/424,525

(22) Filed: Apr. 28, 2003

Related U.S. Application Data

(60) Provisional application No. 60/376,892, filed on May 2, 2003.

(51) Int. Cl.[7] ..... D06C 3/06
(52) U.S. Cl. ..... 38/102.21
(58) Field of Search ..... 74/567; 192/12 B, 192/17 R, 41 R, 43, 110 R, 112; 38/102.21, 102.2, 102, 102.91, 102.4; 101/127.1; 160/378, 381, 403

(56) References Cited

U.S. PATENT DOCUMENTS 192,973 A * 7/1877 Burk ..... 38/102.21
1,643,351 A * 9/1927 Simons ..... 38/102.21
1,975,331 A * 10/1934 Peirce ..... 38/102.21
2,013,128 A * 9/1935 Broeker ..... 38/102.21
5,913,275 A * 6/1999 Flynn ..... 112/119

* cited by examiner

*Primary Examiner*—Ismael Izaguirre

(57) ABSTRACT

A quilting frame for the purpose of both free hand and machine quilting consisting of a pair of frame ends (21 and 22) supporting three rods (25, 26, and 27). The rods (25, 26, and 27) hold material to be quilted. As the quilting process progresses, the material is wound onto the take-up rod (25). The proper tension for both hand and hand-machine guided quilting is applied to each piece of material mounted on the rods through clutch assemblies (55). The quilt frame is adjustable for both tilt and height using assemblies 60 and 65 respectively. The adjustment technique is simple and easy to perform, facilitating both hand and home machine quilting.

2 Claims, 4 Drawing Sheets

PORTABLE MULTIPLE USE QUILTING FRAME SYSTEM

CROSS-REFERENCE TO RELATED APPLICATIONS

This application claims benefit of PPA Serial No. 60/376,892, filed May 2, 2002 by the present inventor.

BACKGROUND OF THE INVENTION

1. Field

This invention relates to a quilting frame system that can be used for hand quilting or machine quilting.

2. Background of the Invention

Quilting frames are used for the purpose of both free hand and machine quilting. They typically consist of a pair of frame ends supporting three rods. The rods hold the material to be quilted. As the quilting process progresses, the material is wound onto one of the rods—the take-up rod. A steady tension is applied to each piece of material mounted on the rods. The tension is important for consistently creating patterns in the material being quilted.

As the material continues to collect on the take-up rod, its diameter increases. When used for machine quilting, the increase in diameter causes a downward pressure to increase drag on the sewing machine. To reduce drag, quilting frames should be adjustable for both tilt and height. The adjustment techniques should be simple and easy to perform, allowing for fine tension adjustment.

Current quilting frame systems are typically set up on a semi-permanent or permanent basis, due to their designs. In order to accommodate the growing home quilting market, a modern quilting frame system should be simple to erect and take down, provide a high degree of portability and be easy to adjust and operate.

Prior patents for quilting frames have presented techniques for tensioning the fabric. U.S. Pat. No. 843,269 discloses a hanging frame using a pin, through a hole in the frame, passing though holes in a disc attached to the end of the pole for tensioning. This tensioning system, while providing positive tension, does not allow for fine tension adjustment. It also requires the use of both hands in the tensioning process.

U.S. Pat. No. 940,070 discloses a floor frame for hand quilting, using a ratchet and pawl tension system. U.S. Pat. No. 988,913 discloses a hanging frame for hand quilting, using a ratchet and pawl arrangement for tensioning. U.S. Pat. No. 1,326,776 discloses a hand quilting device using a ratchet and pawl tension system. The ratchet and pawl tension system provides positive tension and allows for one-hand adjustment, but does not allow for fine tension adjustment.

U.S. Pat. No. 1,843,834 discloses a 2-pole hand quilting system using a radial spline arrangement for pivoting the frame and a friction system for tension adjustment. Friction tension adjustment allows for fine tension adjustment, but does not provide for positive tension adjustment. Over time the friction surfaces can wear down and reduce the effectiveness of such a system. This system requires both hands for tension adjustment.

U.S. Pat. No. 5,913,275 discloses a radial spline coupling approach for both ends of the rods, using a bolt and wing nut to pull the radial splines into engagement. While this approach provides for a finer tension adjustment than the previously stated ratchet and pawl systems, it requires the use of both hands in the tensioning process. One hand holds the rod in the rotated, tensioned position and the other hand tightens the wing nut.

In conclusion, insofar as I am aware, no home quilting frame system formerly developed provides for positive, fine tension adjustment; separate height and tilt adjustment; integral attachment system for clamping to the end of a table or rails. The present invention provides a high degree of portability, versatility and simplicity of operation for the growing number of home quilters.

SUMMARY

The invention, an improved quilting frame system, can be used for hand quilting or machine quilting. The frame is comprised of three spaced, parallel rods supported by a pair of parallel frame ends. The rods are located perpendicular to the frame ends. The frame ends allow for each of the three parallel rods to be individually rotated and individually locked in position for tensioning. The individual rotation and tensioning of the parallel rods is accomplished by attaching one end of each rod to a roller clutch assembly on one of the frame ends and a passive spindle on the other frame end. The top and bottom layers of the material to be quilted are attached to the rods, with the batting sandwiched between these two layers of material. The quilting area between the rods is kept taut to allow for proper quilting of the material.

A pair of vertical rods supports each of the end frames. The support rods attach to the side of the end frames in a manner that allows the end frames to slide vertically along the support rods when the support rod attachments are loose. These two support rods provide the independent height and tilt adjustment for the end frames.

The base of the support rods is a length of channeling. The channeling is oriented such that the open end can be slid over the end of a table, with the support rods resting on top of the channel. The channel also allows for attachment of a rail system for increased portability or extending the length of the quilt frame system for larger quilts. When used with the rail system for extending the quilting frame system, extending both the quilting rods and rails is accomplished by separate extension pieces with attachment devices.

DRAWINGS

DESCRIPTION

Figure 1:
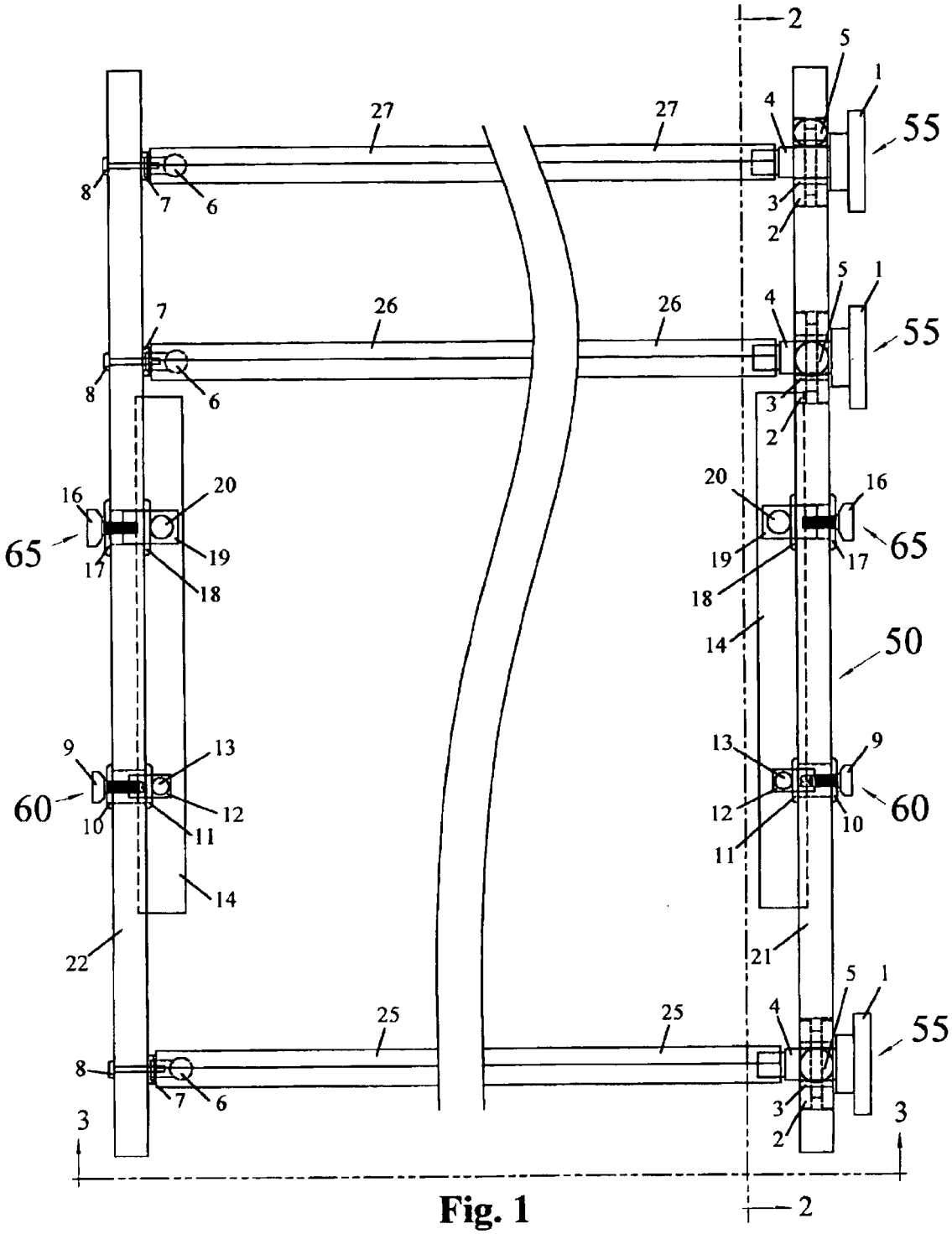
FIG. 1 is a plan view of the quilting frame system according to the present invention.

FIG. 1 is a plan view of the quilt frame 50 of this invention. Three quilting rods 25, 26 and 27 are each supported on the active frame end 21 by shaft 4, which is part of the roller clutch assembly 55. On the passive frame end 22, the three quilting rods are each supported by a passive spindle 6. Each of the frame ends is supported by two clamping systems 60 and 65. These clamping systems are attached to vertical rods 13 and 20 respectively. Height is adjusted on each frame end by loosening knobs 16 and 9, setting the proper height and then re-tightening. Adjusting tilt is performed using only knob 9. The base of each of the support rods is a channel 14. The channel is used for attachment of each frame end to a table end or rail system.

Figure 2:
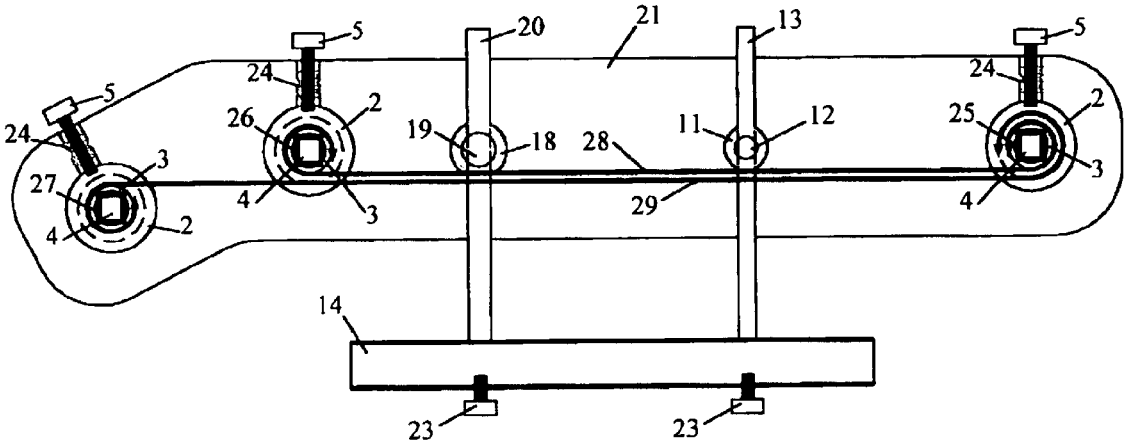
FIG. 2 is a longitudinal sectional view taken along section line 2 of FIG. 1 illustrating arrangement of quilting rods, support rods and roller clutch assembly on active frame end, showing the direction of rotation for tensioning.
Figure 6A:
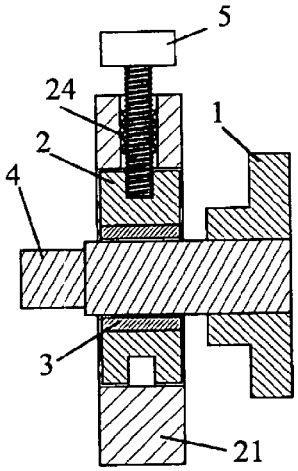
FIG. 6A is side sectional view of the roller clutch assembly illustrating the locking knob tightened against the roller clutch body.
Figure 6B:
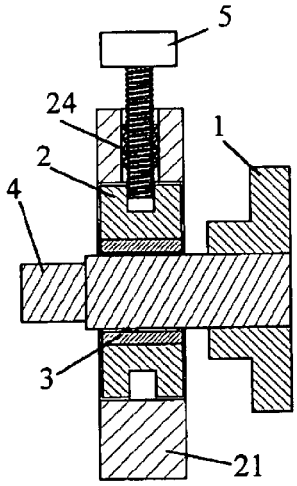
FIG. 6B is side sectional view of the roller clutch assembly illustrating the locking knob loosened, allowing rotation of the roller clutch body.

FIG. 2 is a longitudinal sectional view of the active frame end 21 illustrating the support rods 20 and 13 attached to the base 14 and supporting the active frame end. Knobs 23 provide the clamping force for attachment to the end of a table. The square end of the roller clutch shaft 4 engages the square quilting rods 25, 26 and 27 allowing for control of rotation and tension. The roller clutch 3 is contained in the roller clutch body 2. The lines 28 and 29 are provided to illustrate the direction of rotation for tensioning of fabric placed on the quilting rods 25, 26 and 27. Quilting rod 25 is the take up rod. Both the top layer fabric 28 and the bottom layer fabric 29 are wound onto rod 25. The batting that is sandwiched between these layers is not shown in this illustration. The direction of rotation allowed by the roller clutches when the locking knob 5 is in locked position, as illustrated in FIG. 6A, is indicated by the arrows at the ends of 28 and 29. Rotation of rods 25, 26 and 27 when all three locking knobs 5 are in this position provides for fine tension adjustment. In order to advance the quilting material, locking knobs 5 for roller clutch assemblies associated with rods 26 and 27 must be in the unlocked position as illustrated by FIG. 6B. The locking knob 5 for the roller clutch associated with rod 25 would be in locked position as illustrated in FIG. 6A, allowing it to roll the quilting material on to rod 25.

Figure 3:
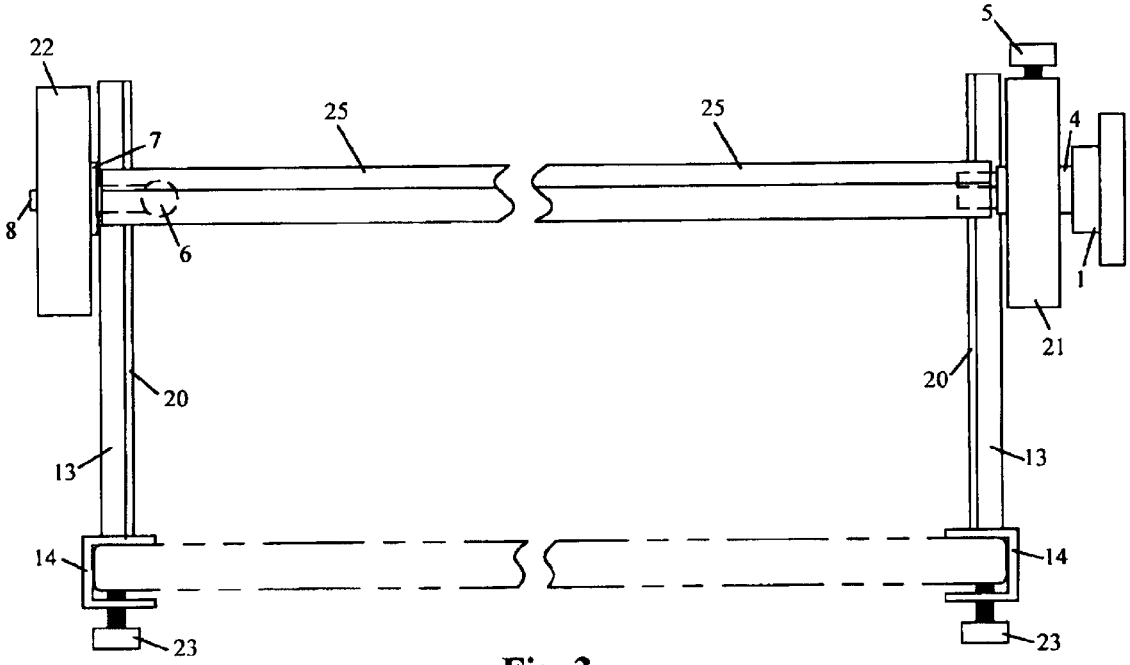
FIG. 3 is a side view taken along section line 3 of FIG. 1 of the frame ends illustrating quilting rods connecting between roller clutch assembly and passive spindle and frame ends clamped to a table.

FIG. 3 is a side view of the quilting frame system. Each frame end channel 14 is shown clamped to a table using knobs 23. Only one of the quilting rods is shown for clarity. The square end of shaft 4 is engaged with the square quilting rod, allowing for rotation using knob 1. The passive spindle 6 on the passive frame end 22 only provides support for the quilting rod.

Figure 4:
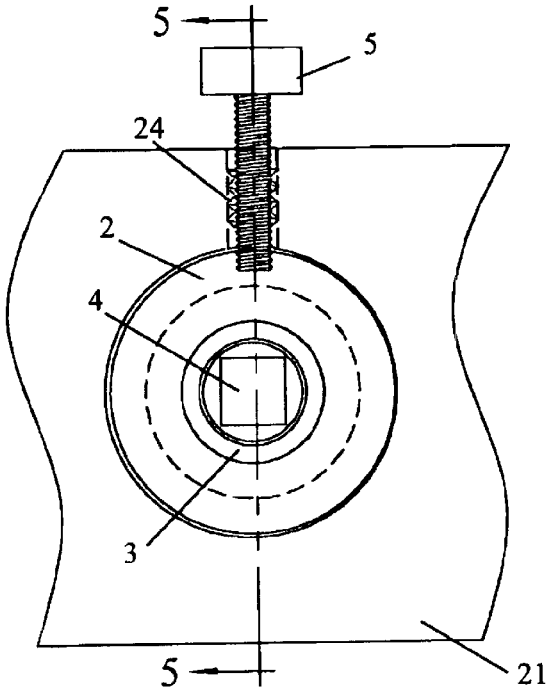
FIG. 4 is an enlarged elevation view of a portion of the active frame end illustrating the roller clutch assembly and locking knob.
Figure 5:
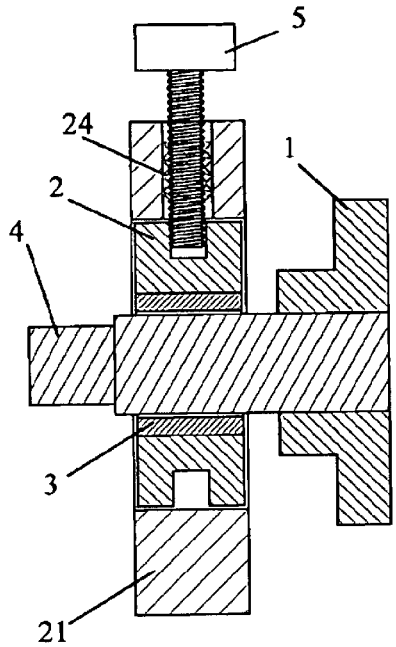
FIG. 5 is a side sectional view taken along section line 5 of FIG. 4 illustrating details of the roller clutch assembly and locking knob.

FIGS. 4 and 5 illustrate the roller clutch assembly 55 and associated locking knob 5 in the frame end 21. Since the frame ends can be fabricated from a relatively soft material such as wood or plastic, the use of a threaded insert 24 provides for a strong threaded receptacle for locking knob 5. The roller clutch 3 is fixed to the roller clutch body 2. When the roller clutch knob 5 is in the position illustrated (also shown in FIG. 6B), the roller clutch body 2 is allowed to rotate freely in both directions within the frame end 21. When the roller clutch knob 5 is tightened against the roller clutch body 2, as illustrated in FIG. 6A, the roller clutch body 2 is pressed against frame 21, disallowing its movement. In this position, the roller clutch 3 will only allow the shaft 4 to rotate in one direction.

Figure 7:
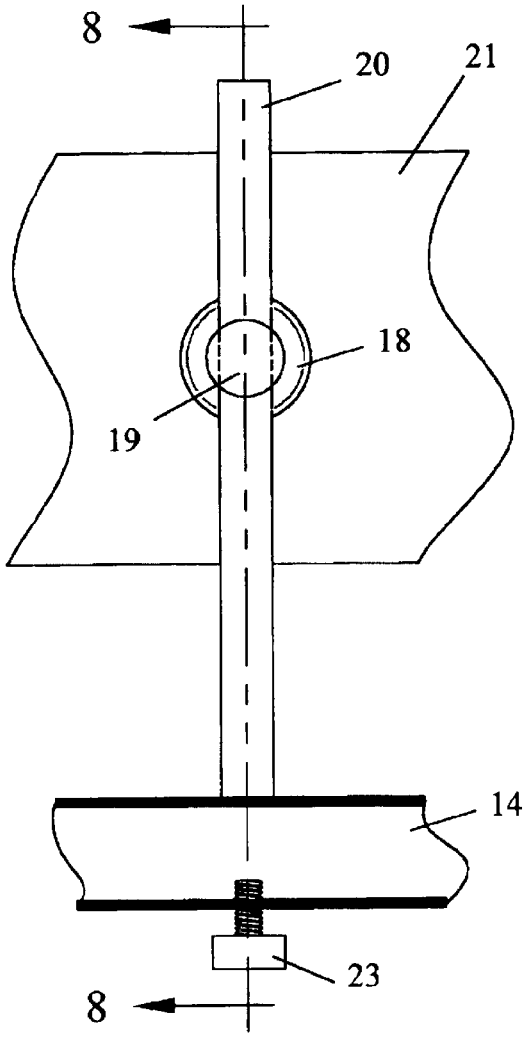
FIG. 7 is an enlarged elevation view of a portion of the active frame end illustrating the main frame end support system.
Figure 8:
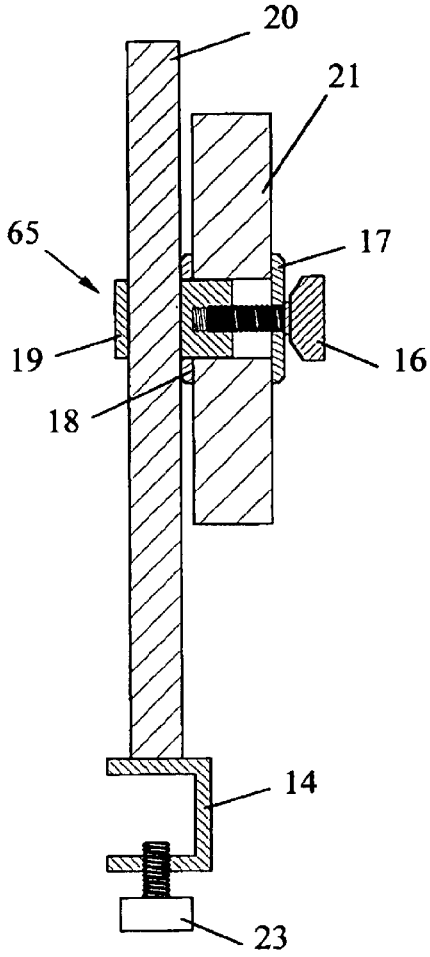
FIG. 8 is a side sectional view taken along section line 8 of FIG. 7 illustrating the frame support system.

FIGS. 7 and 8 illustrate the main frame end support system 65. Both frame support systems 60 and 65 employ the same securing technique, so only the main support system 65 will be described. When securing the frame ends 21 and 22 in proper position, knob 16 (FIG. 8) is rotated, pulling the support body 19 against spacer 18. The support rod 20 is held in place by the tension maintained by knob 16 on support body 19. Due to the contact surface area between 19 and 20, only a small amount of tensioning pressure is required to hold the frame end in place.

REFERENCE NUMERALS IN DRAWING

1. Shaft Rotating Knob
2. Roller Clutch Body
3. Roller Clutch (one-way clutch)
4. Quilt Rod Engaging Shaft
5. Roller Clutch Locking Knob
6. Passive Spindle
7. Spacer
8. Spindle Bolt
9. Angle Knob
10. Washer
11. Washer
12. Angle Support Body
13. Vertical Support
14. Channel
15. None
16. Height Knob
17. Washer
18. Height Support Body
19. Height Support Body
20. Vertical Support
21. Active Frame End
22. Passive Frame end
23. Table Attachment Knob
24. Threaded Insert
25. Quilt Take-up Rod
26. Quilt Top Rod
27. Quilt Backing Rod
28. Top Quilt Layer Illustrative Line
29. Backing Illustrative Line
50. Quilting Frame System
55. Roller Clutch Assembly
60. Tilt Clamping Assembly
65. Height Clamping Assembly

OPERATION

Attach frame end bases 14 to opposite ends of the table and tighten knobs 23. The length of rods 25, 26 and 27 must be approximately equal to the length of the table.

Figure 6C:
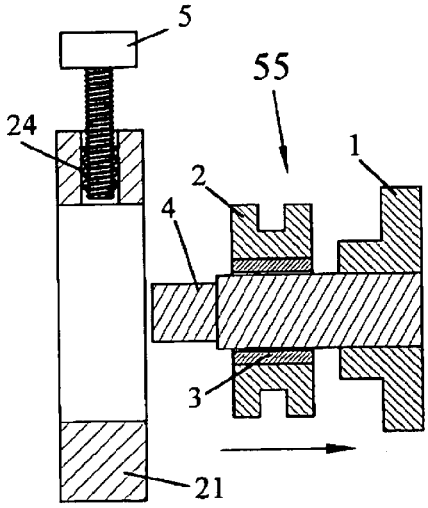
FIG. 6C is side sectional view of the roller clutch assembly illustrating the locking knob recessed into the frame end, and the roller clutch assembly removed from frame.

Remove roller clutch assemblies 55 from frame end 21 by loosening the locking knob 5 to the position illustrated in FIG. 6C.

Attach each of the rods 25, 26 and 27 on passive frame 22 in turn by placing one end of each rod onto spindle 6 on frame 22. Next attach the rod to the active frame end 21, by inserting roller clutch assembly 55 into frame 21 while engaging shaft 4 with the rod end. Place the roller clutch assembly 55 back into the frame end 21, and adjust locking knob 5 to the position illustrated in FIG. 6B. This process is repeated until all three rods 25, 26 and 27 are attached to both frame ends.

Attach cloth leaders to rods 25, 26, and 27. This can be done with tape or other means.

Attach backing of quilt to leader attached to rod 27 using straight pins or other fabric attachment device. Tighten locking knob 5 for roller clutch assembly 55 associated with rod 27 to the position illustrated in FIG. 6A and then roll backing onto rod 27 using knob 1 of roller clutch assembly 55 associated with rod 27.

With quilt top facing up, attach top to rod 26 and in a similar manner roll fabric onto rod 26.

Tighten knob 5 for the roller clutch assembly associated with rod 25 to the position illustrated by FIG. 6A.

Place quilt batting in between rods 26 and 27, sandwiching the batting between the quilt top and quilt bottom Loosen locking knobs 5 for roller clutch assemblies 55 associated with rods 26 and 27 to the position illustrated in FIG. 6B to allow for bi-directional rotation.

Attach all three front edges (backing, batting and top) to cloth leader on take up rod 25. Tighten locking knobs 5 for roller clutch assembly 55 associated with rods 26 and 27 to the position illustrated in FIG. 6A to allow for only one direction of rotation only. If using frame for hand quilting, turn knobs 1 of roller clutch assembly 55 associated with rods 25, 26 and 27 until proper tension is attained.

If frame is to be used with sewing machine on a moveable platform, loosen locking knob 5 for roller clutch assembly 55 associated with take up rod 25 to the position illustrated in FIG. 6C. Remove roller clutch assembly 55 from frame end 21, lift take up rod 25 slightly while pivoting on the associated passive spindle 6 on frame end 22 in order to pass rod 25 through the sewing machine throat. Reattach rod 25 to roller clutch assembly 55 and tighten associated locking knob 5. After assuring all three locking knobs 5 are tightened, turn knobs 1 attached to rods 25, 26, and 27 in the direction allowed by the roller clutch until proper tension is achieved.

Adjust height of end frames 21 and 22 by loosening knob 9 of tilt adjustment assembly 60 and knob 16 of height adjustment assembly 65 on frame end 21. Set height and tighten knob 16. Repeat the process on the passive frame end 22, matching the height of frame end 21. With height adjustment set, adjust frame tilt by moving frame end 21 vertically at a point near rod 25. When the desired position is found, tighten knob 9 and repeat process on frame end 22.

Roll completed quilted areas onto take up rod 25 by loosening locking knobs 5 on roller clutch assemblies associated with rods 26 and 27 and rotate knob 1 of roller clutch assembly associated with roll take up rod 25. Tighten locking knobs 5 on roller clutch assemblies associated with rods 26 and 27 and then selectively rotate all three rods 25, 26, and 27 until proper tension is achieved once more.

As the quilting process progresses, the amount of quilted material on rod 25 will increase. As this occurs, a further adjustment of the height and angle may be required for smooth operation.

To remove completed quilt from frame, loosen all three locking knobs 5 to the position illustrated in FIG. 6B. Unpin back edges on quilt top and bottom from leader on rods 26 and 27 and unroll take up rod 25 until completed quilt is totally unrolled. Then unpin the front edge from the leader attached to take up rod 25.

The foregoing should be considered as illustrative only of the principles of the invention. It is not desired to limit the invention to the exact construction and operation shown and described. Since modifications and changes will readily occur to those with skill in the field, all suitable modifications may be resorted to while falling within the scope of this invention.

What is claimed as new is as follows:

1. A quilting frame system employing a roller clutch assembly comprising, a roller clutch component secured within a housing which is supported internally within a frame member in such a manner as to allow the housing to rotate freely or to be locked in place within the frame member, allowing for a shaft passing through the roller clutch component to rotate freely in both directions when the housing is not locked in place within the frame member and to rotate in only one direction when the housing is locked in place within the frame member.

2. A roller clutch assembly as defined in claim 1 wherein a shaft passing through the roller clutch component engages a quilting rod in a manner that locks the motion of the quilting rod to the motion of the shaft, allowing for unidirectional quilt rod rotation, for the purpose of tensioning and fabric winding or bi-directional quilt rod rotation, for the purpose of fabric tension loosening and fabric unwinding.

* * * * *